United States Patent [19]

Beveridge

[11] Patent Number: 4,481,775

[45] Date of Patent: Nov. 13, 1984

[54] STORED ENERGY POWER GENERATING SYSTEM

[76] Inventor: John Beveridge, P.O. Box 4965, Irvine, Calif. 92716

[21] Appl. No.: 222,803

[22] Filed: Jan. 5, 1981

[51] Int. Cl.[3] ..... F01K 25/06

[52] U.S. Cl. ..... 60/649; 60/673

[58] Field of Search ..... 60/649, 673, 648

[56] References Cited

U.S. PATENT DOCUMENTS 4,009,575 3/1977 Hartman, Jr. et al. ..... 60/673 X

FOREIGN PATENT DOCUMENTS 317928 1/1920 Fed. Rep. of Germany ..... 60/673

*Primary Examiner*—Allen M. Ostrager
*Assistant Examiner*—Stephen F. Husar
*Attorney, Agent, or Firm*—Warren T. Jessup; Richard D. Slehofer

[57] ABSTRACT

A system which stores and uses thermal and chemical energy to provide shaft power during either the charging or discharging cycles. The system is based upon a reversible transfer of gaseous fluid from a holding tank to a receiver. In operation, the fluid generates electricity or other mechanical power by doing work on a turbine or other device positioned between the tank and receiver. The fluid is heated by an external source and is particularly adapted for use with solar energy. The working fluid and an absorbent combine to form the chemical solution. In the charge cycle, heat is applied to the holding tank which distills the fluid. The fluid condenses in the condenser and is held in the receiver. In the discharge cycle, heat is transferred from the still warm holding tank to the receiver by means of piping. The fluid vaporizes and returns to the holding tank. The fluid dilutes the concentrated solution, thereby releasing more heat which in turn is transferred back to the receiver to continue the vaporization of the fluid. The charge cycle is then repeated when solar energy heats the holding tank and distills the working fluid from the diluted solution until most of the fluid is driven from the solution.

14 Claims, 4 Drawing Figures

CHARGE MODE

TEMPERATURE, °F
350
300
250
200
150
100
CONCENTRATION
85
80
70
60
50
30
0%
TANK
END
START
CONDENSER-RECEIVER
1
1.5
2
3
4
5
6
7
8
9
10
15
20
30
PRESSURE, PSIA

DISCHARGE MODE

TEMPERATURE, °F
350
300
250
200
150
100
CONCENTRATION
85%
80
70
60
50
30
0
TANK
START
END
RECEIVER
1
1.5
2
3
4
5
6
7
8
9
10
15
20
30
PRESSURE, PSIA

REFRIGERATION MODE

TEMPERATURE, °F
300
250
200
150
100
50
0
CONCENTRATION
85%
80
70
60
50
30
0
TANK
START
END
RECEIVER
0.1
.15
.2
.3
.4
.5
.6
.7
.8
.9
1.0
1.5
2.0
3.0
PRESSURE, PSIA

STORED ENERGY POWER GENERATING SYSTEM

BACKGROUND OF THE INVENTION

The rapid depletion and the increased usage of the world's petroleum supplies is changing the economics of energy storage and energy conversion systems. Use of solar energy is becoming fashionable and economical for water heating and home heating. Use of solar energy for domestic electricity is imminent.

Aqueous-acid solutions such as sulphuric acid solutions have long been known to release heat as the solution is further diluted with water. Also it is well known that distilling a dilute acid-water solution vaporizes water (working fluid) thus making the remaining solution more concentrated with acid (absorbent). Since the heat of solution or absorption is a significant amount of energy per unit weight of solution, chemical energy can be used for thermal energy storage. At least one U.S. Department of Energy program is concerned with the use of sulphuric acid-water solutions as a means to store thermal energy and chemical energy to produce a refrigeration-heating effect.[1] This program does not consider nor include conversion of available thermodynamic energy of the working fluid for the production of shaft power, nor does the disclosure include a discharge mode which uses thermal and chemical energy available in the concentrated solution to vaporize the working fluid held in the receiver.

[1]Paper presented at ASME Annual Meeting 1978, Energy Storage Session, entitled "Sulfuric Acid-Water Chemical Heat Pump/Energy Storage System Demonstration" by E. Charles Clark, Rocket Research Company, Redmond, Wash. and Carl C. Hiller, Sandia Laboratories, Livermore, Ca.

A Swedish heat storage system is described in the November 1980 issue of *Popular Science Magazine*[2] which uses water as the working fluid and sodium sulphite as the absorbent for the solution. This system uses solar energy to charge the system and an underground heat exchange loop for heat sink during charging and as heat source for discharging. Use of the available thermodynamic energy for conversion to shaft power is not described or suggested.

[2]"Double Duty Heat Pump" by David Scott, pps 56–62, Popular Science Magazine, November 1980, Volume 217, No. 5.

This invention provides for economical storage of thermal energy and for conversion of a portion of the thermal energy to shaft power which can in turn be used to generate electricity or mechanical refrigeration. Heat rejected from the system may be useful for domestic heating, water heating, or the like. A unique feature of this invention is that power conversion is provided during the daylight charging cycle of the system and during the non-daylight discharging cycle of the system. The energy supply for the discharging cycle is stored as sensible thermal energy and chemical energy in the solution contained in the holding tank.

SUMMARY OF THE INVENTION

A system which stores and uses thermal and chemical energy to provide shaft power during the charging and discharging cycles. The system is comprised of a chemical holding tank which can be heated by a solar panel causing one of the chemicals, the working fluid, within the tank to be boiled off (or distilled) as a dry superheated vapor. The solvent vapor or working fluid is piped through a turbine thereby generating electricity, then passed to a condenser. The cooled spent fluid is collected in a receiver. This is the charging cycle. In the discharge mode, the fluid flow is reversed. The fluid in the receiver is heated by drawing heat away from the chemical holding tank. The fluid in the receiver again vaporizes off and is passed through the turbine thereby generating electricity again. The spent cooled fluid is returned to the chemical holding tank. The chemical holding tank has an absorbent and a working fluid. The absorbent remains in the holding tank, while the working fluid is distilled therefrom, when heat is applied to the tank. The operation of the cycle operates upon the principle that the vapor pressure of the working fluid is reduced when combined with the absorbent in the holding tank. By maintaining the solution at the proper temperature and concentration, the vapor pressure of the solution in the tank can be kept lower than the vapor pressure of the working fluid in the receiver.

DETAILED DESCRIPTION OF THE PREFERRED EMBODIMENT

Figure 1:
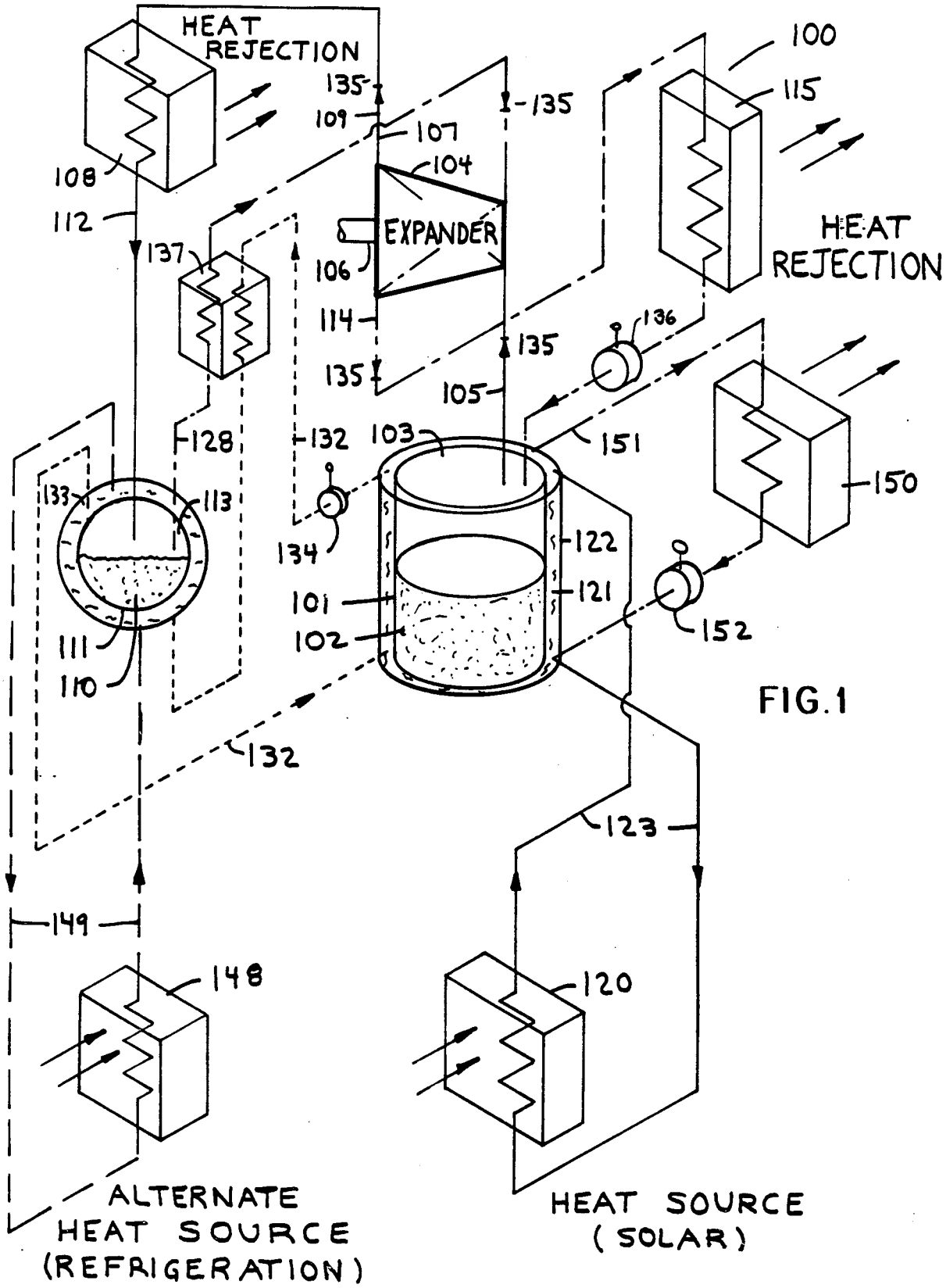
FIG. 1 illustrates a schematic line diagram of a stored energy power generating system showing charging, discharging and thermal refrigeration modes.

The system is most easily understood by referring to the schematic diagram in FIG. 1. The basic components are used for both charging and discharging of the system. However, the direction of the working fluid is reversed for the discharging cycle relative to the charging cycle. The solid lines refer to the charging cycle, and the dotted, dot-dash and dashed lines refer to the discharging cycle.

The overall system 100 has an inner holding tank 101 containing a solution 102 comprised of a working fluid 103 such as water, a hydrocarbon, or a fluorocarbon and an absorbent such as an acid, a base, or a salt. During charging, vapors of working fluid 103 from the solution 102 pass to the vapor expansion means or turbine 104 via the pipe 105. The fluid flows past the vanes of the turbine 104, causing the shaft 106 to rotate. Available thermodynamic energy is converted to kinetic energy and leaves the system via the shaft 106 of the turbine. Other vapor expansion means, such as piston expanders, are contemplated and are within the scope of the invention. Turbine exhaust vapors 107 flow to the condenser means 108 via the pipe 108. Heat rejected from the condenser 109 may be utilized for useful purposes not pertinent to the operation of the system 100. Liquid working fluid 110 from the condenser 108 is collected in the receiver means 111 via the pipe 112. When the system is discharging (dot-dash line), fluid 110, such as water in the receiver 111 is vaporized and fluid 113 again passes through a working fluid vapor expansion means or device 104 to convert available thermodynamic energy to power. The thermodynamic energy available in the system is utilized in both the charging and discharging modes of operation. The expanded gaseous working fluid 114 may condense in a discharge condenser 115 or in the solution 102.

The charging process is characterized by thermal energy input to the system 100. A solar panel 120 or other suitable thermal energy source can be utilized as a means for adding thermal energy to the solution in the tank 101. Energy transfer from the solar panel 120 to the solution 102 can be accomplished with an energy transfer substance 121 circulated from the solar panel 120 by thermal syphon to the outer tank 122 via the closed loop lines 123. Heat is transferred by conduction through the wall of inner tank 101. The transfer of thermal energy to the solution 102 causes the working fluid to distill or boil-off. The superheated gaseous working fluid 103 passes through the vapor expansion means or turbine 104 where they are used to generate power. The vapors convert a portion of their heat into work during their passage through the turbine and the cooled fluid 107 flows to the fluid condenser means 108. The fluid 110 from the condenser 108 is collected and passes to the receiver 111.

Figure 2:
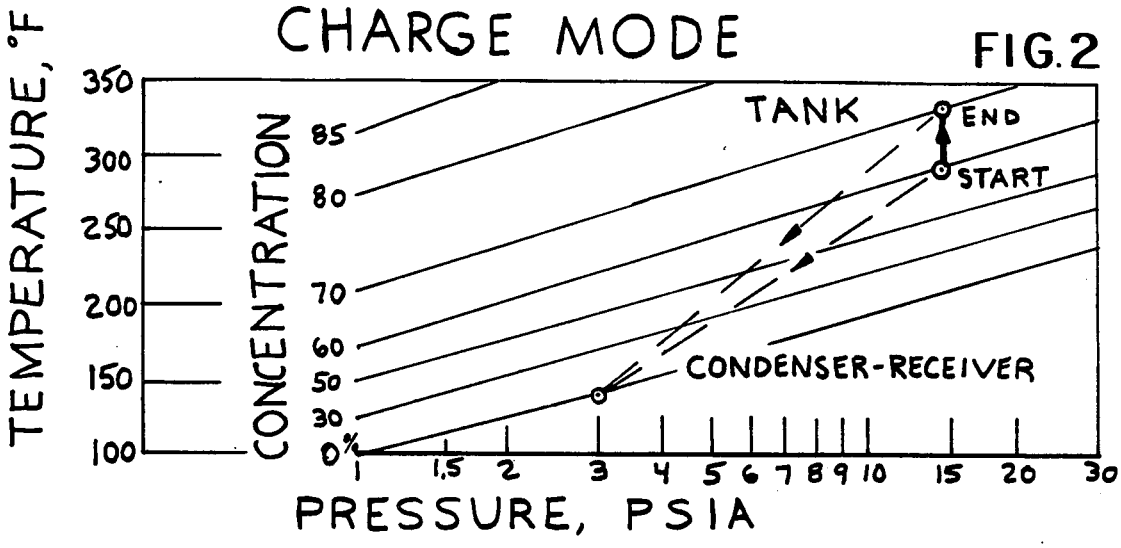
FIG. 2 illustrates log vapor pressure versus temperature curves for dilute sulphuric acid defining typical charging mode state points.

In FIG. 2, typical solution temperature-vapor pressure relationships are shown. The parameter of temperatures and pressures will vary with the type of absorbent and fluid used and the concentration of the absorbent. The graphs shown in FIG. 2 are for a solution of sulphuric acid and water. The source for these data is Greenewalt, Ind. Eng. Chem., 17:522,1925. During a typical charging cycle, the temperature and concentration of the solution 102 increase as shown in FIG. 2. The pressure and temperature in a typical receiver are also shown. It may be noted that the fluid 110 in the condenser has a pressure and temperature which is significantly less than the pressure and temperature of the tank solution 102, i.e., a pressure ratio in the range of about two to twenty indicates that thermodynamic energy is available for useful turbine power output and a measureable temperature drop across the turbine 104 can be obtained by the vapors. The dotted lines approximate the pressure-temperature state points within the turbine 104.

The discharging cycle for the system occurs when the input of thermal energy is not available such as is the case for night-time operation. For this operating mode, the system flow schematic is altered slightly as shown by the dotted and dot-dash lines in FIG. 1. The source of energy for the operation of the system 100 during the discharging cycle is the stored thermal energy of the solution 102 and the chemical energy of the concentrated solution 102.

The discharging mode of operation is characterized by raising the temperature and vapor pressure of the working fluid 110 (water) by heating and thereby vaporizing the working fluid 110 in the receiver 111 using thermal energy from the solution 102. Thus thermal energy is transferred from tank 101 to receiver 111 to vaporize the fluid 110. As the fluid 110 is heated, the tank solution 102 is cooled because of the heat transferred. Selection of the proper relative amounts of fluid and absorbent provides the desired temperature changes with little heat loss from the system. The heat transfer is accomplished as follows.

In FIG. 1, a closed loop 132 (dotted lines) is provided to transfer thermal energy from the tank solution 102 to the receiver liquid 110. This loop 132 transfers heat from the solution 102 from the outer tank 122 to the jacket 133 surrounding the receiver 111. A control valve 134 must be open to allow thermal syphon circulation of heat transfer fluid in the closed loop 132. Thermal syphon circulation does not occur in the heat transfer loop 123 when heat is not being added to the panel 120. When appropriate, pumps may be used to circulate substances in the transfer loops in lieu of thermal syphon circulation.

For the discharging mode, a separate vapor expansion means (not shown in FIG. 1) or check valves 135 may be provided in the piping (solid and dot-dash lines) to ensure the normal direction of flow or working fluids 113 through the turbine 104. A second condenser means or discharge condenser 115 may be provided to condense all or a portion of the turbine outlet vapors 114 prior to their return to the solution 102 in the tank 101. With some solutions or system operating conditions a condensate-feed pump 136 may be required to return the condensed fluid to the solution 102 in the tank 101.

Figure 3:
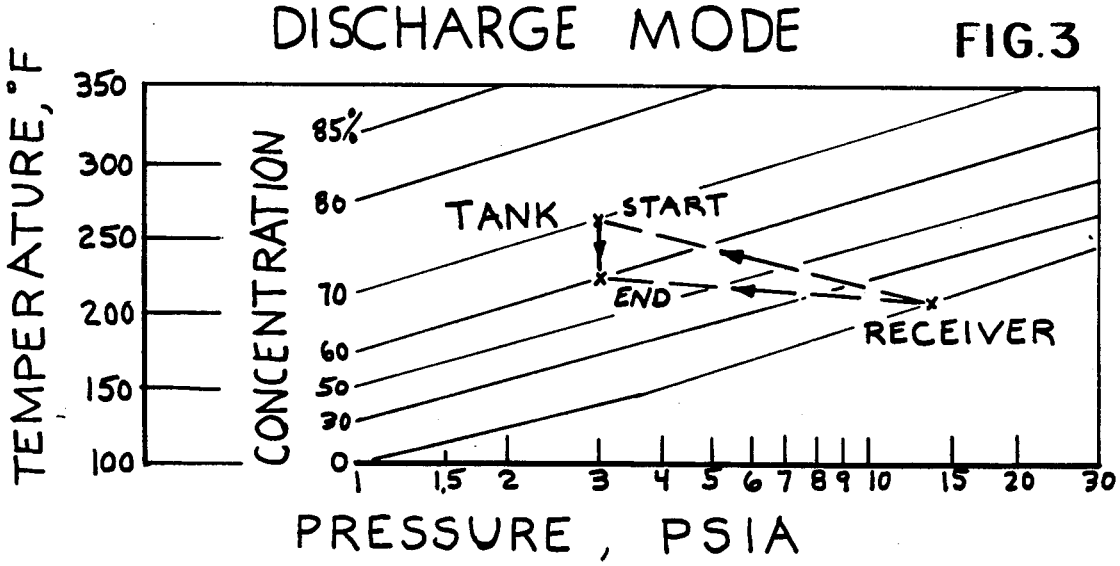
FIG. 3 illustrates log vapor pressure versus temperature curves for dilute sulphuric acid defining typical discharging mode state points.

In FIG. 3, typical relationships are shown for working fluid temperatures and vapor pressures in the receiver and the corresponding temperature and vapor pressure range of the solution 102 in the tank 101 for the discharging mode. It may be noted that the vapor pressure of the fluid 110 in the receiver 111 is significantly greater than the vapor pressure of the solution in the tank even though the temperature of the solution 102 in the tank 101 is higher. Vapors can flow against the differential temperature due to the chemical attraction between the molecules of the concentrated solution 102 in the tank 101.

It may also be noted from FIG. 2 and FIG. 3 that the inlet pressure and pressure ratio for the vapor expansion means 104 or turbine are similar for the charging and discharging modes. This is desirable to maintain turbine performance and power output for both operating modes.

For the temperatures and pressures depicted in FIG. 3 for the discharging mode, operation of the pump 136 would not be required, i.e., the system operates without a condensate-feed pump. Some heat must be rejected from the discharge condenser 115 to decrease the temperature of the solution during the discharging mode if a constant turbine exhaust pressure is maintained. Heat rejected from the discharge condenser 115 may be useful for other than system operational purposes. When heat is not rejected from the discharge condenser 115, the major means for loss of heat from the system is via the shaft 106 power output. This heat loss is offset by the thermal energy released as the working fluid 110 dilutes the solution 102 in the tank 101. In general, some heat loss from the system is desirable to maintain the vapor pressure of the solution 102 as its concentration decreases during the discharging cycle. This feature is not essential. Thus the power conversion system can function without heat rejection in the conventional sense, i.e., heat rejection to exhaust or heat rejection via a condenser.

In some systems a superheater 137 may be incorporated to superheat the vapors 113 prior to expansion. The superheater 137 enhances turbine 104 performance.

The discharging cycle is completed when the working fluid 110 has been vaporized. To return the system 100 to the charging mode, the control valve 134 is closed to prevent heat flow to the receiver 111.

Diverse types absorbents and working fluids may be utilized. For example, salt-water solution when the salt is magnesium chloride or lithium bromide; ammonia-water solution; methanol-water; and even a fluorocarbon such as Freon 12. These chemical solutions are well known for absorption cycle refrigeration systems which operate under the same principle as this invention does. Sulphuric acid (absorbent) and water (working fluid) solution is particularly desirable for solar energy power and low temperature thermal systems because these chemicals are inexpensive, readily available and provide reasonable temperatures, pressures and specific volumes. Per FIG. 1, the sulphuric acid solution 102 is double contained and is retained in the inner tank 101.

The system 100 output in the form of shaft 106 power may be used to generate electricity or high level (mechanical) refrigeration during the charging or discharging cycles. In addition, a thermal refrigeration effect can be obtained during the discharging mode by flowing heat to the liquid 110 in the receiver 111 from an alternative (to be refrigerated) heat source 148 via piping 149 (dash lines in FIG. 1). In this alternative system, waste heat would normally be rejected from the working fluid 114 by the discharge condenser 115 and/or the solution 102 would be cooled by a heat rejection loop (dot-dash lines in FIG. 1) comprising a heat exchanger 150, piping 151 and flow control valve 152. Operation of the vapor expansion means 104 (dot-dash lines) in the thermal refrigeration mode may or may not be desirable. When the vapor expansion means 104 is utilized, the temperature of the heat sink for the discharge condenser 115 and/or the temperature of the heat sink for the heat exchanger 150 must be lower than when the vapor expansion means 104 is not used.

It should be noted that the thermal refrigeration effect minimum temperature is limited by the freezing temperature of the working fluid 110 while the minimum temperature which can be obtained by mechanical refrigeration obtained from the shaft 106 power of the vapor expansion means 104 is not temperature limited. The amount of refrigeration (heat flow) is much larger for the thermal refrigeration effect in comparison with the mechanical refrigeration.

Figure 4:
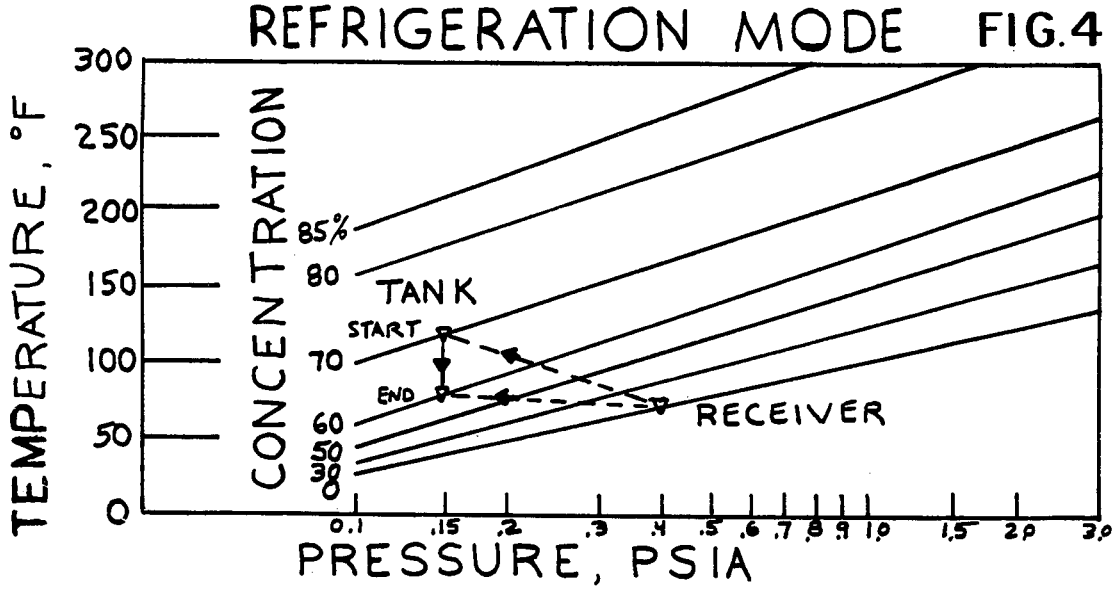
FIG. 4 illustrates log vapor pressure versus temperature curves for dilute sulphuric acid defining typical thermal refrigeration mode state points.

FIG. 4 shows typical temperature-vapor pressure relationships for dilute sulphuric solution system when discharging in a thermal refrigeration mode with a vapor expansion turbine 104 in operation. All working fluid and solution temperatures and vapor pressures are reduced when compared with a typical charging mode as depicted in FIG. 2 or the normal discharging mode as depicted in FIG. 1.

It is to be understood that holding tank 101, turbine 104, condenser 108 and receiver 111 are interconnected by hermetically sealed conduits and piping so that there will be no outside air leakage into the charge or discharge cycles.

Obviously, many modifications and variations are possible in light of the above teachings. It is therefore to be understood that the full scope of the invention is not limited to the details disclosed herein and may be practiced otherwise than as specifically described.

What is claimed is:

1. A method of cycling thermodynamic energy comprising:

adding heat to a working fluid in a receiver means to vaporize said fluid;

passing said fluid vapors through a conversion means;

condensing vapors of said working fluid;

accumulating said working fluid in a holding tank containing an absorbent which has a strong molecular attraction for said fluid;

transferring heat from said fluid and absorbent in said tank to said fluid in said receiver means.

2. The method as recited in claim 1 further comprising pumping said fluid from said receiver means into said tank.

3. A system comprising:

a holding tank containing a solution further comprising an absorbent and a working fluid;

condenser means for condensing vapor of said working fluid;

receiver means for containing said condensed vapors of said working fluid;

means for adding thermal energy to said solution in said tank for charging said system;

means for transferring thermal energy from said solution in said holding tank to vaporize said working fluid in said receiver means for discharging said system;

working fluid vapor expansion means for utilizing available thermodynamic energy during charging or discharging of said system;

piping means for interconnecting said tank, said vapor expansion means, said condenser means, and said receiver means.

4. A system as recited in claim 3, wherein said working fluid expansion means includes means for utilizing available thermodynamic energy during both charging and discharging of said system.

5. A system as recited in claim 4 further comprising pumping means for pumping condensed liquid working fluid into said tank.

6. A system as recited in claim 3 wherein said working fluid expansion means is a fluid dynamic turbine.

7. A system as recited in claim 4 further comprising means for superheating working fluid vapors from said receiver means.

8. A system as recited in claim 3 wherein said working fluid is water and said absorbent is an acid.

9. A system as recited in claim 8 wherein said acid is sulphuric acid.

10. A system as recited in claim 8 wherein said absorbent is a base.

11. A system as recited in claim 3 wherein said absorbent includes a salt.

12. A system as recited in claim 3 wherein said working fluid includes a hydrocarbon.

13. A system as recited in claim 3 wherein said working fluid is a fluorocarbon.

14. A system comprising:

a tank containing a solution further comprising an absorbent and a working fluid;

working fluid vapor expansion means for converting available thermodynamic energy into kinetic energy;

condenser means for condensing vapors of said working fluid;

receiver means for containing said working fluid;

heat exchanger means corrected to said receiver means for producing a refrigeration effect during discharge of said system by flowing heat to said working fluid;

means for removing thermal energy from said solution in said tank during discharge of said system;

means for adding thermal energy to said solution in said tank to charge said system;

and piping means for interconnecting said receiver means, said vapor expansion means, said condensing means, and said tank.

* * * * *